US009249953B2

(12) United States Patent
Miskin

(10) Patent No.: US 9,249,953 B2
(45) Date of Patent: Feb. 2, 2016

(54) LED LAMP HAVING A SELECTABLE BEAM ANGLE

(71) Applicant: Lynk Labs, Inc., Elgin, IL (US)

(72) Inventor: Michael Miskin, Sleepy Hollow, IL (US)

(73) Assignee: LYNK LABS, INC., Elgin, IL (US)

( * ) Notice: Subject to any disclaimer, the term of this patent is extended or adjusted under 35 U.S.C. 154(b) by 0 days.

(21) Appl. No.: 14/357,319

(22) PCT Filed: Nov. 13, 2012

(86) PCT No.: PCT/US2012/064887
§ 371 (c)(1),
(2) Date: May 9, 2014

(87) PCT Pub. No.: WO2013/071313
PCT Pub. Date: May 16, 2013

(65) Prior Publication Data

US 2014/0313717 A1 Oct. 23, 2014

Related U.S. Application Data

(60) Provisional application No. 61/558,828, filed on Nov. 11, 2011.

(51) Int. Cl.
*F21V 14/08* (2006.01)
*F21V 14/06* (2006.01)
(Continued)

(52) U.S. Cl.
CPC . *F21V 14/08* (2013.01); *F21K 9/13* (2013.01); *F21K 9/50* (2013.01); *F21K 9/58* (2013.01); *F21V 11/10* (2013.01); *F21V 14/06* (2013.01); *F21Y 2101/02* (2013.01)

(58) Field of Classification Search
USPC ..... 362/322, 323, 324, 277, 280, 281, 283, 362/284
See application file for complete search history.

(56) References Cited

U.S. PATENT DOCUMENTS 3,869,641 A 3/1975 Goldberg
4,218,627 A 8/1980 Kiesel
(Continued)

FOREIGN PATENT DOCUMENTS

EP 1 215 944 A1 6/2002
JP 08-137429 5/1996
(Continued)

OTHER PUBLICATIONS

International Search Report and Written Opinion for PCT application No. PCT/US2012/064887, 15 pages.

*Primary Examiner* — Laura Tso
(74) *Attorney, Agent, or Firm* — Factor Intellectual Property Law Group, Ltd.

(57) ABSTRACT

An LED lamp having a lamp housing including a lamp base capable of connecting to a source of electrical power and at least one LED lighting device having at least one LED, the lighting device being electrically connected to the lamp base offset from a center line running vertically through the center of the housing. The lamp further includes at least one optic having at least two sub-optics, each sub-optic capable of allowing a different beam angle of light distribution to pass there through when aligned with the LED lighting device, the optic being integrated with the lamp housing such that the optic may be rotated to align one sub-optic over the LED lighting device at a time.

53 Claims, 5 Drawing Sheets

(51) Int. Cl.

| | |
|---|---|
| ***F21K 99/00*** | (2010.01) |
| ***F21V 11/10*** | (2006.01) |
| *F21Y 101/02* | (2006.01) |

(56) References Cited

U.S. PATENT DOCUMENTS

| | | | | |
|---|---|---|---|---|
| 4,298,869 | A | 11/1981 | Okuno | |
| 4,298,920 | A * | 11/1981 | Gluck et al. | 362/281 |
| 5,699,218 | A | 12/1997 | Kadah | |
| 5,790,013 | A | 8/1998 | Hauck | |
| 6,107,744 | A | 8/2000 | Bavaro et al. | |
| 6,614,103 | B1 | 9/2003 | Durocher et al. | |
| 6,781,570 | B1 | 8/2004 | Arrigo et al. | |
| 6,879,451 | B1 | 4/2005 | Hewlett et al. | |
| 7,048,408 | B2 * | 5/2006 | Dallas et al. | 362/202 |
| 7,489,086 | B2 | 2/2009 | Miskin et al. | |
| 7,562,995 | B1 | 7/2009 | Levine | |
| 7,859,196 | B2 | 12/2010 | Lee et al. | |
| 8,148,905 | B2 | 4/2012 | Miskin et al. | |
| 8,179,055 | B2 | 5/2012 | Miskin et al. | |
| 2003/0043611 | A1 | 3/2003 | Bockle et al. | |
| 2003/0122502 | A1 | 7/2003 | Clauberg et al. | |
| 2003/0137844 | A1 * | 7/2003 | Bucher et al. | 362/293 |
| 2003/0169014 | A1 | 9/2003 | Kadah | |
| 2003/0175004 | A1 | 9/2003 | Garito et al. | |
| 2004/0080941 | A1 | 4/2004 | Jiang et al. | |
| 2004/0183380 | A1 | 9/2004 | Otake | |
| 2004/0189218 | A1 | 9/2004 | Leong et al. | |
| 2004/0201988 | A1 | 10/2004 | Allen | |
| 2005/0110426 | A1 | 5/2005 | Shao | |
| 2005/0173990 | A1 | 8/2005 | Andersen et al. | |
| 2006/0038542 | A1 | 2/2006 | Park et al. | |
| 2006/0103913 | A1 | 5/2006 | Handschy et al. | |
| 2006/0138971 | A1 | 6/2006 | Lang et al. | |
| 2006/0158130 | A1 | 7/2006 | Furukawa | |
| 2007/0069663 | A1 | 3/2007 | Budalski et al. | |
| 2007/0236931 | A1 | 10/2007 | Chien | |
| 2008/0116816 | A1 | 5/2008 | Neuman et al. | |
| 2008/0136347 | A1 | 6/2008 | Lin et al. | |
| 2008/0158915 | A1 | 7/2008 | Williams | |
| 2008/0203405 | A1 | 8/2008 | Rooymans | |
| 2008/0203936 | A1 | 8/2008 | Mariyama et al. | |
| 2008/0211421 | A1 | 9/2008 | Lee et al. | |
| 2008/0218098 | A1 | 9/2008 | Lee et al. | |
| 2009/0002992 | A1 | 1/2009 | Dallas et al. | |
| 2009/0021185 | A1 | 1/2009 | Ng | |
| 2009/0295300 | A1 | 12/2009 | King | |
| 2010/0039794 | A1 | 2/2010 | Ghanem et al. | |
| 2012/0043897 | A1 | 2/2012 | Miskin et al. | |
| 2012/0069560 | A1 | 3/2012 | Miskin et al. | |
| 2012/0242239 | A1 | 9/2012 | Miskin et al. | |
| 2012/0268008 | A1 | 10/2012 | Miskin et al. | |
| 2012/0293083 | A1 | 11/2012 | Miskin et al. | |
| 2013/0051001 | A1 | 2/2013 | Miskin et al. | |

FOREIGN PATENT DOCUMENTS

| | | | |
|---|---|---|---|
| JP | 11-016683 | | 1/1999 |
| JP | 11-330561 | A1 | 11/1999 |
| WO | 2008124701 | | 10/2008 |

* cited by examiner

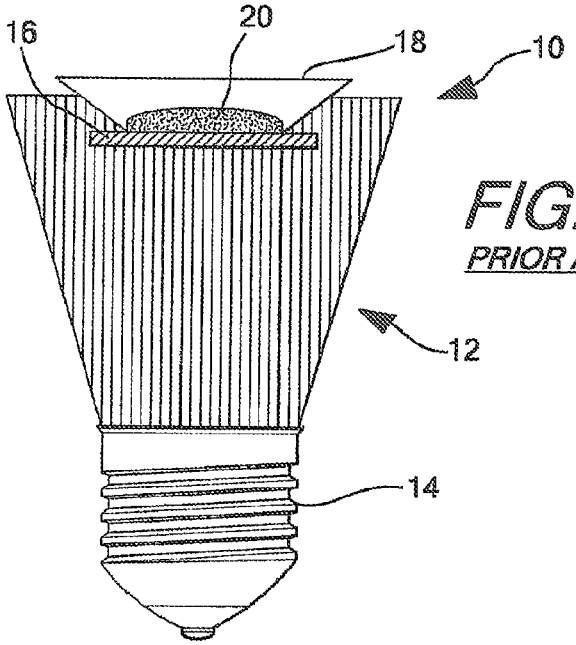
FIG. 1
PRIOR ART
FIG. 2
PRIOR ART
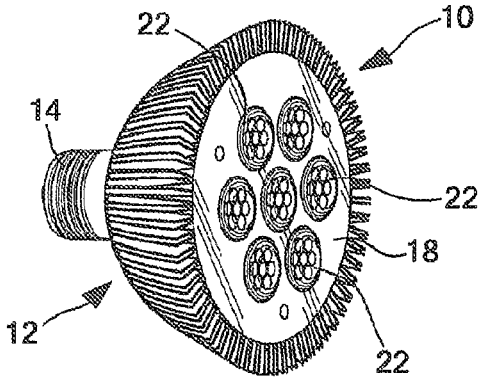
FIG. 3
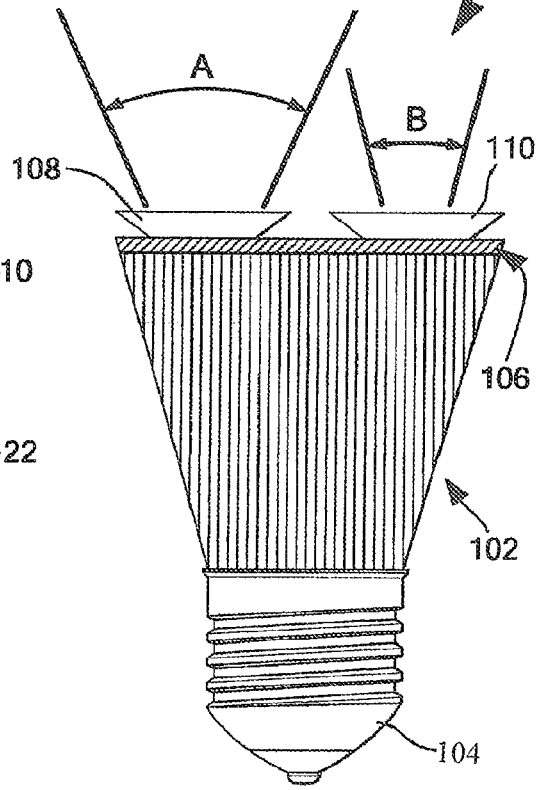

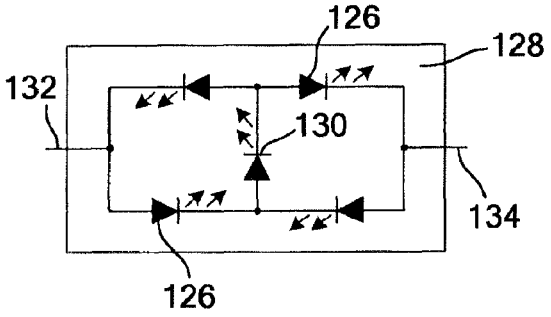
FIG. 10
FIG. 11
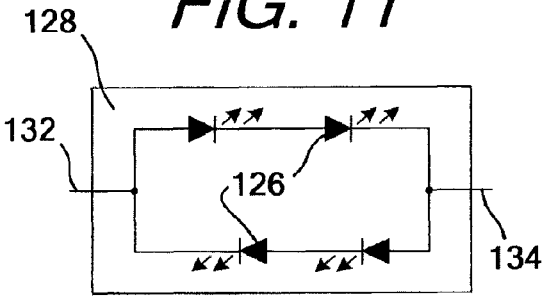
FIG. 12
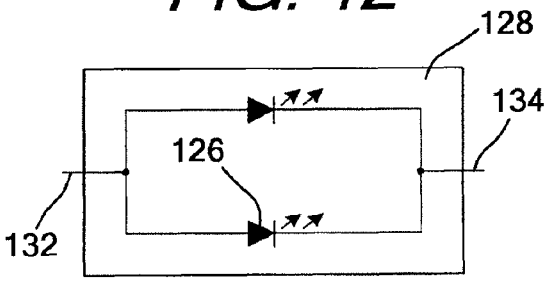
FIG. 13
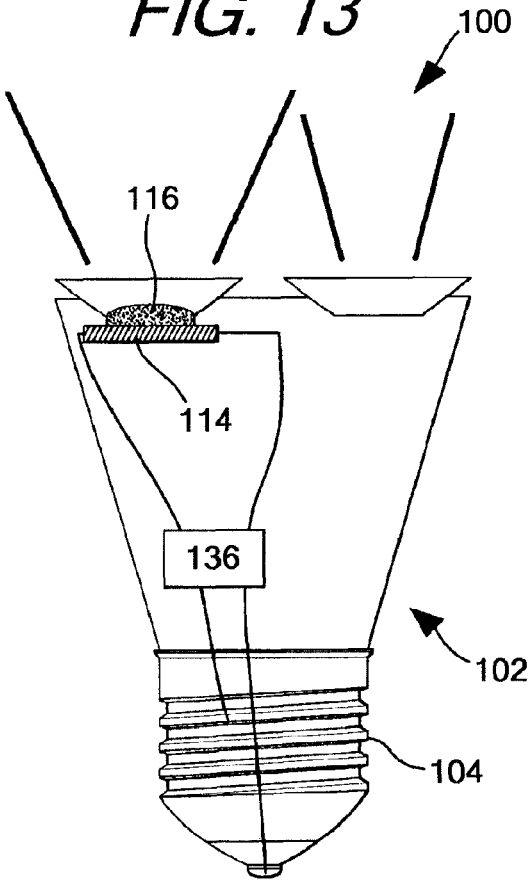

LED LAMP HAVING A SELECTABLE BEAM ANGLE

RELATED APPLICATIONS

This application is a 371 national phase of International Application No. PCT/US2012/064887 filed Nov. 13, 2012 which claims priority to U.S. Provisional Application No. 61/558,828 entitled "LED LAMP WITH SELECTABLE BEAM ANGLE OPTIC METHOD AND APPARATUS" filed Nov. 11, 2011—the contents of both of which are expressly incorporated herein by reference.

TECHNICAL FIELD

The present invention generally relates to light emitting diode ("LED") lamps, and more specifically to LED lamps having an optic integrated therewith, the optic being capable of rotating to allow different beam angles of light to be emitted by the LED lamp.

FEDERALLY SPONSORED RESEARCH OR DEVELOPMENT

None.

BACKGROUND OF THE INVENTION

LEDs are semiconductor devices that produce light when a voltage and current is supplied to them. LEDs are intrinsically DC devices that only pass current in one polarity. Historically LEDs have been driven by constant current or constant voltage DC. More recently, new inventions have demonstrated that LEDs may also be driven direct with low voltage AC or high voltage AC, and with low voltage and high voltage rectified AC.

The increasing adoption and advancement of LED technology has resulted in the development of new LED lighting devices and LED lamps which may replace legacy lamps or light bulbs. However, the known LED lamps use one or more LEDs with one fixed optic over each LED, a single optic over multiple LEDs, or a single LED with a single optic over the LED. These LED lamps do not provide a means of selecting more than one beam angle of light distribution from the LED lamps. Depending on location and use of an LED lamp, multiple beam angles may be needed depending on the surface, products or areas an end user desires to light by the lamp.

Furthermore, having to switch lamps to achieve a different beam angle regardless of the operational state of the lamp and lighting device within is inefficient and wasteful. LED lamps are typically more costly than legacy light bulbs or lamps and being unable to realize the full life of the lamp simple because a different desired beam angle is sought raises consumer costs and wastes operable LED lamps.

Rather than have to remove and replace an LED lamp having a different beam angle each time a new beam angle is desired or required, it would be advantageous to design an LED lamp having the capability to emit light in multiple beam angles.

The present invention is provided to solve these and other issues.

SUMMARY OF THE INVENTION

Accordingly, the present invention is directed to an LED lamp or light bulb having two or more sub-optics which are integrated and configured with the LED lamp so that a single LED lamp may emit light in various beam angles.

According to one aspect of the invention, an LED lamp is provided. The LED lamp includes a lamp housing having a lamp base capable of connecting to a source of electrical power, like for example a lighting system or light fixture which may be connected to a source of power, like mains power, or have an internal power source. Housed within the lamp housing and electrically connected to the lamp base is at least one LED lighting device having at least one LED, the LED lighting device being mounted in an offset position from a center line running vertically through the center of the LED lamp housing. The LED lamp may further include at least one optic having two sub-optics, each sub-optic capable of allowing a different beam angle of light distribution to pass there through when aligned over the LED lighting device. The optic may be integrated with, or formed as part of, the lamp housing and configured such that the optic may be rotated to align one selected sub-optic with the LED lighting device at a time. Each sub-optic may allow one desired beam angle of light to be emitted by the LED lamp.

According to another aspect of the invention, at least one sub-optic in the optic may allow a different pattern, or intensity, of light to be emitted by the LED lamp when aligned with the at least one LED lighting device.

According to another aspect of the invention, one of the at least two sub-optics may allow for light to pass through it in a beam angle less than 60 degrees.

According to another aspect of the invention, one of the at least two sub-optics may allow for light to pass through it in a beam angle greater than 60 degrees.

According to another aspect of the invention, the at least one lighting device housed in the LED lamp may include an LED circuit, the LED circuit including LEDs formed as a bridge rectifier with an LED connected across the output of the rectifier.

According to another aspect of the invention, the at least one lighting device housed in the LED lamp may include an LED circuit, the LED circuit including at least two LEDs connected in an anti-parallel configuration.

According to another aspect of the invention, the at least one lighting device housed in the LED lamp may include an LED circuit, the LED circuit including at least two LEDs connected in series. The at least two LEDs may be formed as a bridge circuit having one or more LEDs connected across the output essentially forming two anti-parallel series circuits having one or more common LEDs. Alternatively, the at least two series LEDs may be connected in a series string configuration.

According to another aspect of the invention, the LED lamp may further including an LED drive circuit or LED driver housed within the housing. The LED drive circuit may be electrically connected to both the lamp base and the LED lighting device so as to receive power from the LED lamp base and provide the received power to the LED lighting device.

According to another aspect of the invention, the LED drive circuit housed within the LED lamp may include a bridge rectifier, a transformer and/or an inverter. The bridge rectifier may rectify AC voltage and current, and provide a DC voltage and current to the LED lighting device. The transformer may be capable of stepping voltage received by the LED drive circuit from the lamp base up or down before supplying voltage to the at least one LED light source. Likewise, the inverter may be capable of stepping a voltage frequency received from the lamp base up or down before supplying voltage to the at least one LED light source.

According to another aspect of the invention, the LED lamp may include at least two LED lighting devices and at least two groups of sub-optics, each of the at least two LED lighting devices being electrically connected to the lamp base. Each group of sub-optics may include one sub-optic for each of the at least two LED lighting devices, each sub-optic within each group being capable of emitting a substantially identical beam angle, and the sub-optics of one of at least one of the at least two groups are capable of emitting a different beam angle of light than the sub-optics of any other of the at least two groups.

According to one aspect of the invention, a method of selecting the output light beam angle from an LED lighting device is provided. In order to select the output beam angle, a lamp housing having a lamp base, the lamp base being capable of receiving electrical power from a power source, like for example a lighting system or lighting fixture, is provided. At least one LED lighting device is electrically connected to the lamp base so that electrical power may be provided from the lamp base to the LED lighting device. At least one optic is provided or integrated with the housing, the optic being rotatable with respect to the housing and having at least two sub-optics, the sub-optics being configured so that only one of the at least two sub-optics may be aligned over the LED lighting device at a time. Each sub-optic allows light to pass there through. The lamp base may be connected to a source of electrical power, like for example a lighting system or a lighting fixture, and the optic may be rotated to align one of the at least two sub-optics with the at least one LED lighting device to allow light emitted by the LED lighting device to pass there through at a selected beam angle.

Other advantages and aspects of the present invention will become apparent upon reading the following description of the drawings and detailed description of the invention.

BRIEF DESCRIPTION OF THE DRAWINGS

FIG. 1 shows an exemplary prior art lamp having a single optic providing a single beam angle;

FIG. 2 shows an exemplary prior art lamp;

FIG. 3 shows a front view of a lamp having multiple optics as contemplated by the present invention;

FIG. 10 shows an LED lighting device which may be used within the lamp of FIG. 3;

FIG. 11 shows an LED lighting device which may be used within the lamp of FIG. 3;

FIG. 12 shows an LED lighting device which may be used within the lamp of FIG. 3; and, FIG. 13 shows a cross-section of an embodiment of the lamp shown in FIGS. 3 and 4 taken along the line 5-5 in FIG. 4.

DETAILED DESCRIPTION OF PREFERRED EMBODIMENTS

Figure 4:
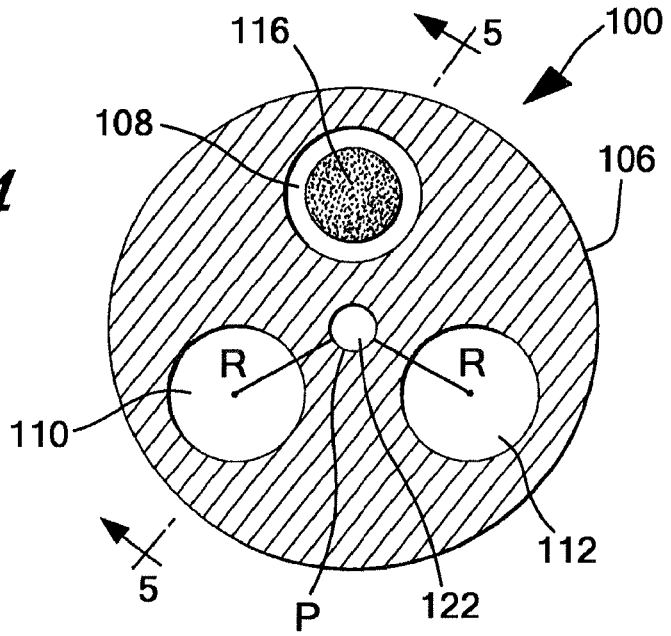
FIG. 4 shows a top view of the lamp of FIG. 3.

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

FIG. 1 shows an example of a LED lamp known in the art with an LED light source, phosphor emission port and a portion of the optic located within the lamp being shown in the front view. As seen in FIG. 1, lamp 10 has housing 12 which includes base 14. Housed within housing 12 is a single LED lighting device 16 and potentially any drivers or other circuitry required to provide power to the lighting device. Integrated with housing 12 is a single optic 18 and a phosphor emission port 20. Optic 18 allows only a single beam angle of light to pass through and emit from lamp 10.

FIG. 2 shows a further prior art example of an LED lamp known in the art. As seen in FIG. 2, LED lamp 10 may include an optic 18 having multiple optics 22, optic 18 being integrated with and fixed to housing 12. Each optic 22 allows only a single beam angle from an associated LED lighting device to pass there through, and the beam angle of each optic is substantially identical. The alignment of LED lighting devices and sub-optics would all be substantially similar to that shown in FIG. 1, with each sub-optic being substantially aligned over an individual LED lighting device.

Whether one or multiple LEDs or LED lighting devices are utilized in the known prior art lamps, in order to change the angle of light emitted from the lamp or system into which the lamp is integrated, lamp 10 would have to be replaced with a similarly designed lamp with a different optic or optics so that the different beam angle may be realized, regardless of the operational state of the LED lighting device housed therein.

The present invention provides an LED lamp having a single optic having multiple sub-optics, each sub-optic being capable of emitting a different beam angle of light. FIGS. 3 and 4 respectively show a front view and a top view of an LED lamp as contemplated by the present invention. As seen in FIGS. 3 and 4, lamp 100 has housing 102 which includes lamp base 104. Integrated with housing 102 is optic 106 having at least two, and as seen in FIG. 4 three, sub-optics 108, 110, 112 which are each capable of emitting light at a different beam angle than the other sub-optics when aligned with a light source located within lamp 100 and housing 102.

Optic 106 may be formed as part of housing 102, or may be an external device which integrates with the housing in order to provide the effects of each integrated sub-optic. As used herein with respect to the present invention, the term sub-optic may be an optic or beam shaping mechanism for a light source, which in the present invention is an LED. Each sub-optic may be, for example, an individual lens or reflector, or a combination thereof, which provides a specific light beam distribution angle. Though the examples of a lens or reflector are used herein, it is contemplated by the invention that any light beam shaping mechanism or optic may be integrated with the optic as a sub-optic to provide a particular light beam angle or light effect, with the possibility that different types of sub-optics may be incorporated into a single optic.

Figure 5:
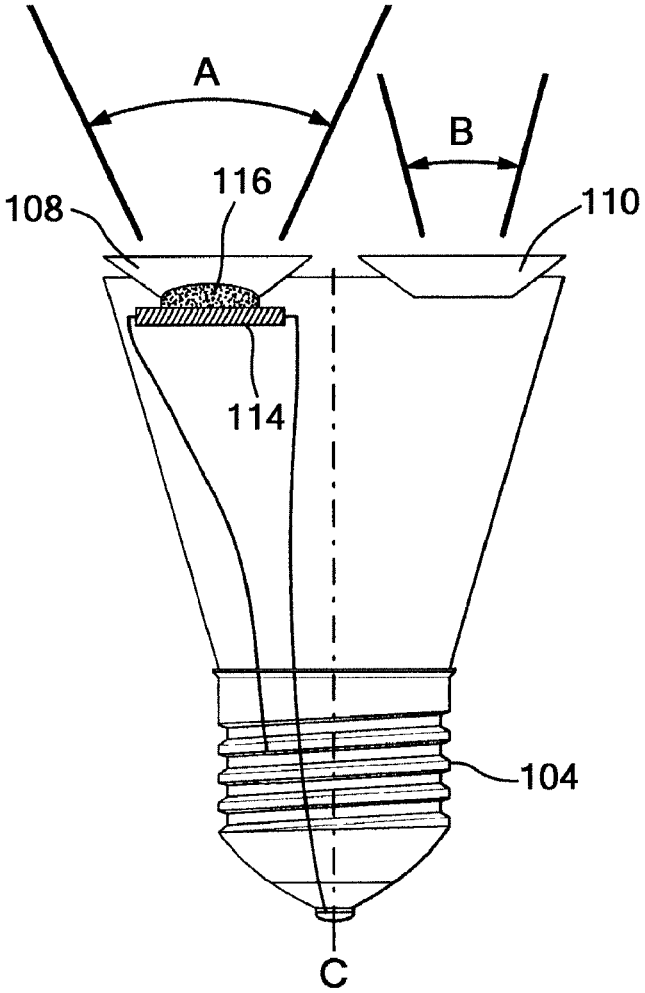
FIG. 5 shows a cross section of the lamp of FIGS. 3 and 4.

As seen in FIG. 5 which is a cross section of the lamp of FIGS. 3 and 4 taken along the line 5-5 in FIG. 4, housed within housing 102 is LED lighting device 114. As seen in FIG. 5, LED lighting device 114 may be offset from center line C which extends vertically through the center of housing 102. This offset can also be seen in FIG. 4, which shows phosphor emission port 116 which may be located directly over lighting device 114. As seen in FIG. 4, when viewing lamp 100 from above, the lighting device is located towards one side of the circular optic 106 which is integrated with or forms the top portion of housing 102.

As seen in FIG. 5, for example, sub-optics 110, 112 may be configured to allow different beam angles, for example A and B in FIG. 3, to pass there through when aligned with LED lighting device 114. The desired beam angle may be selected by, for example, simply rotating optic 106 and aligning a selected sub-optic over the lighting device (shown in FIGS. 4 and 5 as optic 108). The beam angle of light emitted from each sub-optic refers to the total angle bounded by the edges of the light emitted from each sub-optic. For example, beam angle A may be 40° from edge to edge, while beam angle B may be 10° from edge to edge. While some light may diffuse to areas located outside this area, the light emitted by the lamp will primarily be focused and at its most intense in areas located within the beam angle allowed by each sub-optic. Each sub-optic may bend, refract, focus or otherwise manipulate the light emitted by an internal lighting device to permit light to pass through at the desired beam angle when it is placed directly over the lighting device. While one standard beam angle may be emitted by each sub-optic, like for example 10°, 40° and 90° beam angles, the sub-optics may be custom designed to allow any desired beam angles to pass there through, depending upon the end users requirements.

In addition to providing sub-optics which may control the beam angle, one or more of the sub-optics may additionally or alternatively control one or more of the pattern and intensity of the light emitted by lamp 100. For example, sub-optics 108 and 110 in FIG. 4 may allow light to pass through at a beam angle of 40° and 10° respectively, while sub-optic 112 may allow a particular pattern of light to pass there through, like for example three horizontal bars of light separated from each other by unlit lines. In order to achieve the desired effect, any sub-optic may include different focal characteristics and may include any required reflectors or refractors to bend and manipulate the light into the desired pattern. Rather than provide a specific pattern, sub-optic 112 may allow light to pass through at a selected angle which may be similar or different from sub-optics 108 and 110, but may have a different intensity level by, for example, frosting or tinting the optic to manipulate the strength of nature of the light passing through sub-optic 112.

As previously mentioned, a phosphor emission port or silicone phosphor encapsulate 116 may be provided with the LED lighting device in order to modify the light emitted there from. As shown in FIGS. 4 and 5, for example, a single port or encapsulate may be provided with lighting device 114. Alternatively, each sub-optic may include its own port or encapsulate to further alter the characteristics and quality of light emitted by each optic.

Figure 6A:
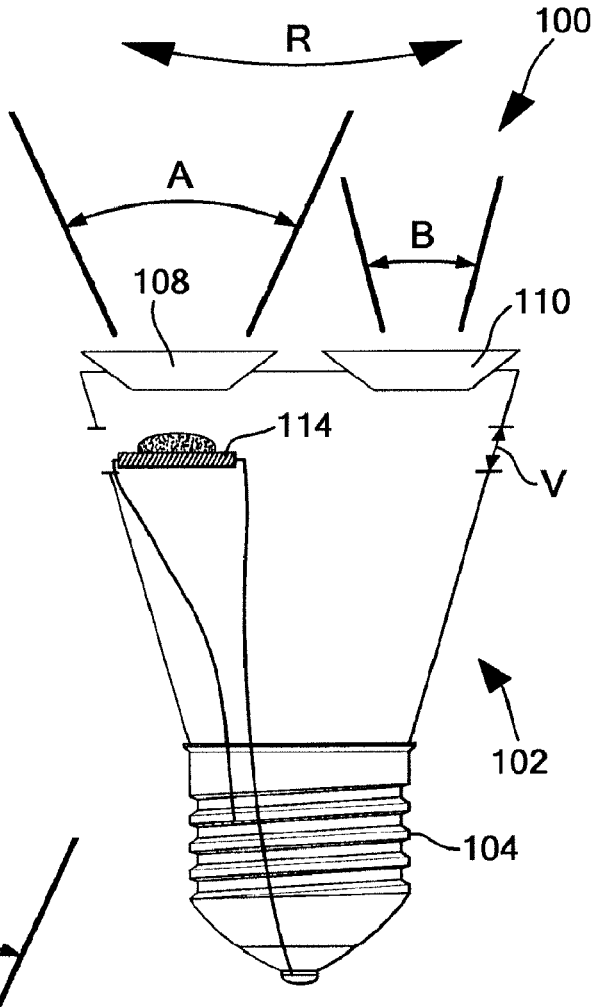
FIG. 6A shows the cross section of FIG. 5 with the optic or fitting lifted and rotated.
Figure 6B:
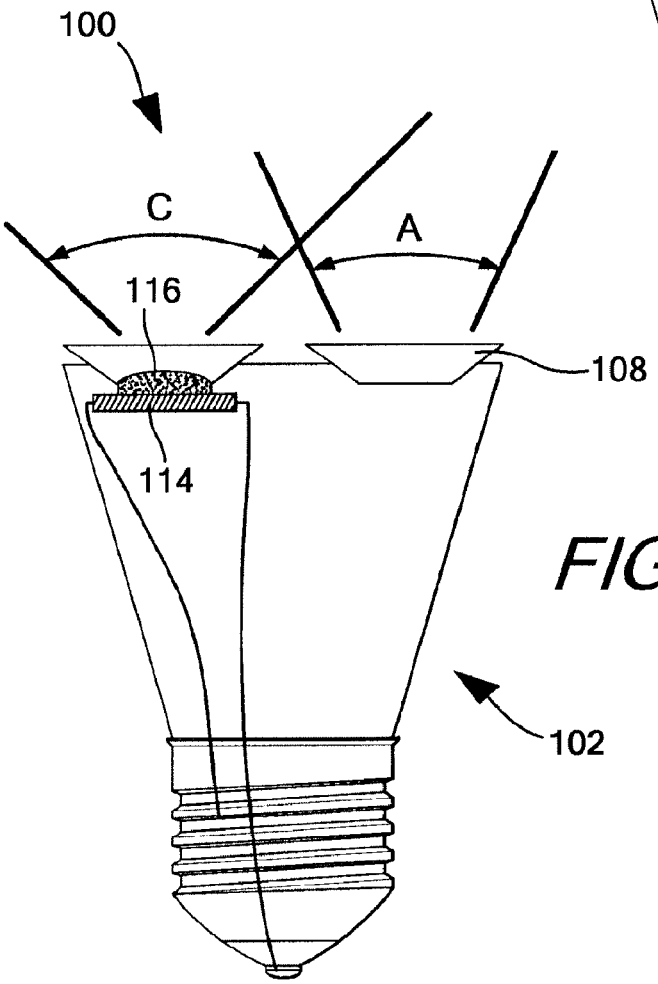
FIG. 6B shows the cross sectional of FIG. 5 with a new optic or fitting aligned with the lighting device of the lamp contemplated by the invention.

Optic 106 may be integrated with, or formed as part of, housing 102 using any means known in the art which permits optic 106 to be rotated to align a desired sub-optic over LED lighting device 116. In order to rotate optic 106 and select a different sub-optic having a different beam angle or light characteristic, as seen in FIGS. 6A and 6B which shows cross section of FIG. 5 with optic 106 lifted and rotated in direction R to select a new sub-optic, the optic may lifted vertically a small distance V from housing 102, or the remainder of housing 102, and rotated until the newly selected sub-optic is located over lighting device 114. As shown in FIGS. 6A and 6B, optic 106 may be lifted and rotated so that sub-optic 112 aligns with lighting device 114, replacing sub-optic 108 and allowing lamp 100 to emit beam angle C.

Figure 7:
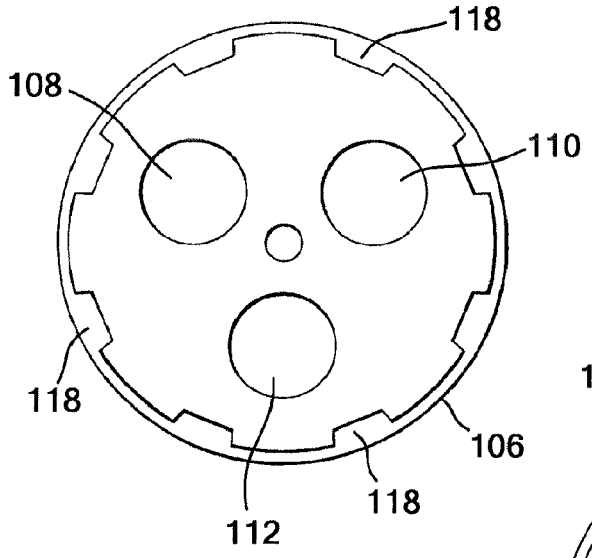
FIG. 7 shows a bottom view of a fitting as contemplated by the present invention.
Figure 8:
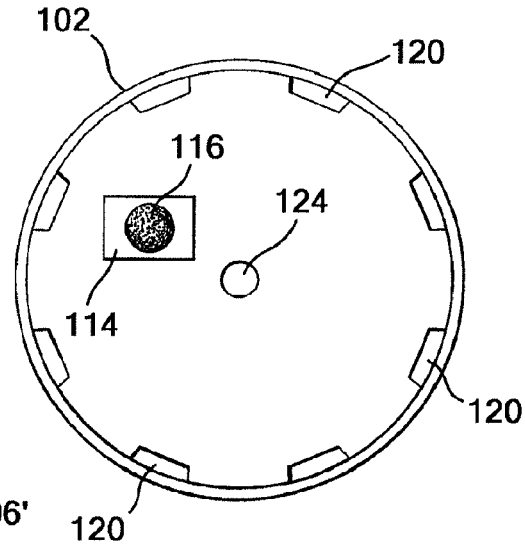
FIG. 8 shows a top view of the lamp of FIGS. 3 and 4 having the optic removed.

In order to fix optic 106 in place and prevent unwanted rotation once the desired sub-optic is aligned, optic 106 and housing 102 may include matching gear teeth like structures which engage only when one sub-optic is located over the lighting device. For example, as seen in FIG. 7 which shows the bottom of optic 106 and FIG. 8 which shows a top view of housing 102 with optic 106 removed, optic 106 and housing 102 may include mating gear teeth 118 and 120 respectively, which may permit the optic to be locked in place with any cavity or optic over lighting device 114. In order to insure engagement, optic 106 may be spring loaded to drop or be pulled in place and engage the matching gear teeth within housing 102 once rotated. Rather than lift optic 106 to rotate it, it is contemplated that that the optic may be rotated by being depressed and rotated within a slot within housing 102 until the next matching gear teeth arrangement is met. In such embodiments, any spring loading would snap the optic upwards, engaging the optic gear teeth with the housing gear teeth once the desired beam angle is positioned over the device.

Alternatively, rather than be spring loaded, a fastener, like for example a screw, may be provided as shown in FIG. 5. Fastener 122 may extend down through optic 106 and engage receptacle 124 (shown in FIG. 8) within housing 102. In order to rotate the optic and align a different sub-optic with the lighting device, the fastener may be loosened, allowing the optic or fitting to be lifted or removed and/or rotated before being positioned back in place and re-engaging housing 102. Once re-engaged, fastener 122 may be replace and/or tightened to hold optic 106 in place. Where a fastener is used, it may still be advantageous to include gear teeth or a similar structure to insure the selected sub-optic is substantially aligned and fixed in place over lighting device 114.

Offsetting LED lighting device 116 from the center of lamp 100 allows sub-optics 108, 110, and 112 to be selectively placed over lighting device 114 as optic 106 is rotated. As seen in FIGS. 4 and 5 and described above, LED lighting device 114 may be set to one side lamp 100 so that only a single cavity or optic, shown in both FIGS. 4 and 5 as sub-optic 108, may be positioned over the lighting device. By setting the lighting device to the outside, each sub-optic may be positioned directly over the lighting device, regardless of the sub-optic size and characteristics as optic 106 is rotated. In order to take full advantage of the offset, each sub-optic 108, 110, 112 may be positioned at a substantially similar radius R from center point P on optic 106 so that regular rotation of the optic will substantially position each sub-optic directly over lighting device 114 when each sub-optic is aligned with the lighting device. When not positioned directly over lighting device 114, the remaining sub-optics, shown as sub-optics 110, 112, may be positioned over any substantially opaque structure to prevent light from lighting device 114 from passing there through. For example, un-selected sub-optics may be positioned over a portion of housing 102, or any included heat sink or light blocking structure.

Figure 9:
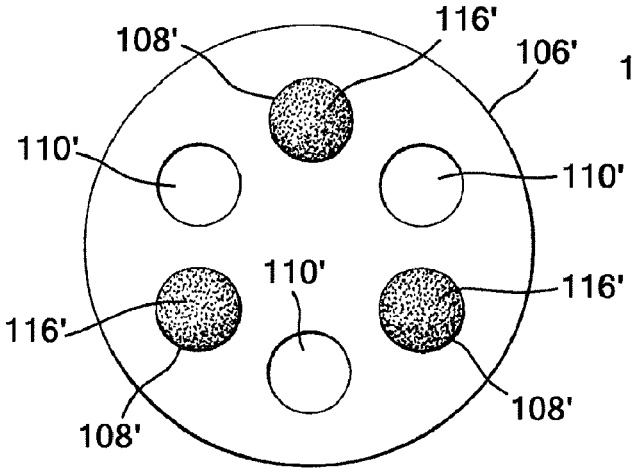
FIG. 9 shows a top view of a lamp as contemplated by the invention.

Rather than provide a single LED lighting device, as seen in FIG. 9, it is contemplated by the invention that multiple, i.e. three, lighting devices may be provided within a single lamp. In order to provide light at different beam angles from lamps having multiple light sources, optic 106' may be provided which includes multiple groups of sub-optics, the sub-optics forming each group emitting a substantially identical beam angle while each group of sub-optics has emits a different beam angles. A first group of sub-optics may be placed over each lighting device so that the lamp emits three beams of light, each having a substantially identical beam angle. Optic 106' may then be rotated to so that a second group of sub-optics is placed over the lighting devices so that three beams of light having a different beam angle than the first are emitted. For example, as seen in FIG. 9, when sub-optics 108' are aligned with the LED lighting devices and phosphor emission ports 116', three beams of light having a 40° beam angle may be emitted. If optic 106' is rotated and sub-optics 110' are aligned with the LED lighting devices, three beams of light having a 10° beam angle may be emitted. It is contemplated that any number of lighting devices and beam angles may be incorporated into a single lamp, so long as an equal number of sub-optics for each beam angle is provided for each LED lighting device.

Regardless of the number of lighting devices and sub-optics included in lamp 100, each LED lighting device 114 within housing 102 may be any combination of a single LED on a substrate, or an LED chip, package, or any other LED device known in the art. Any LED chips or packages may include multiple LEDs 126 connected in any configuration known in the art. For example, as seen in FIGS. 10-12, LEDs 126 may be integrated on a single substrate 128 and/or a printed circuit board, or may be discretely packaged and connected, and formed as a bridge rectifier with at least one LED 130 connected across the output (FIG. 10), in an anti-parallel configuration (FIG. 11), or in a series string configuration (FIG. 12). No matter whether each LED is integrated on a single substrate or discretely packaged and connected, or the lighting device only includes a single LED on a substrate, the LED chip, package or other device may include input and output terminals 132, 134 for electrically connecting the lighting device to lamp base 104. The LEDs may be electrically connected to the terminals and each other to form the desired configuration and utilize the voltage and current provided by lamp base 104 using any means known in the art, with any conductors required to make any connections provided within the device as needed.

Though shown in FIGS. 3-6B as an Edison base or screw base, lamp base 104 may be configured in any manner known in the art, including wedge bases or festoon bases, each having different shapes and electrical connection points. Regardless of the shape and electrical inputs, lamp base 104 may receive power, i.e. voltage and current, from a source of electrical power. The source of electrical power may be a lighting system or lighting fixture having a matching receptacle for the lamp base and a connection to a source of power, like for example mains power, or an interior power source, like for example a battery. Depending upon which base is used, the shape of housing 102 may be altered to accommodate the requirements of base 104 and any lighting system or fixture into which lamp 100 may be integrated.

In addition to housing lighting device 114, housing 102 may further house any other required elements for lamp 100. Additional elements which may be housed within housing 102 include but are not limited to, any conductors or wiring required to electrically connect any elements including base 104 and lighting device 114 including any LED drivers, a heat sink, any fasteners or fastener receptacles required for holding any element in place, any gear teeth, springs, or other features used to rotate and lock optic 106 in place, and any light blocking structures required to prevent light from passing through any optics not substantially aligned with the lighting device. Rather than include a heat sink within housing 102, it is contemplated that at least a portion, or all, of housing 102 may be formed as a heat sink to more efficiently control the temperature of the LED lighting device and components within lamp 100.

As seen in FIG. 13, it is contemplated by the invention that an LED drive circuit or LED driver 136 may also be housed within housing 102. LED driver 136 may be electrically connected to both lamp base 104 and LED lighting device 108, and may form the electrical connection between the lamp base and the lighting device when the lamp base and lighting device are not directly connected. When configured to form the electrical connection between the lamp base and lighting device, the LED driver may receive power from the lamp base, modify, alter or otherwise control the voltage and/or current provided from the base, and provide the modified, altered or otherwise controlled voltage and current to the lighting device.

LED drive circuit or LED driver 136 may be electrically connected to lamp base 104 using any means known in the art so that the power received by base 104 may be transmitted to, and received and utilized by, drive circuit 118. When lamp bases other than that shown in FIGS. 3-6B and 13 are incorporated into housing 102 and lamp 100, the connection and positioning of drive circuit 136 within housing 102 may vary. So long as power received by a lamp base incorporated in the LED lamp is provided to the drive circuit or driver, drive circuit 136 may be positioned anywhere within housing 102. The power received by drive circuit 136 may then be transmitted to lighting device 114 to illuminate the same. Lighting device 114 may be electrically connected to drive circuit 136 using any means known in the art.

LED drive circuit or LED driver 136 may include any components required to modify and transmit power received from lamp base 104 to drive LED lighting device 104. Drive circuit 136 may include a step-up or step-down transformer, an inverter for changing the AC frequency of an AC input voltage or to modify a provided DC voltage to an AC voltage, and/or a bridge rectifier for transforming a provided AC voltage to DC. Drive circuit 136 may additionally include any other circuitry used in the art in LED drivers, like for example switches, voltage or current suppressors or regulators, or fuses to protect the LED lighting device from power surges. The driver may, for example, include an input which receives power from base 104, an inverter which steps the frequency of the received voltage up, a transformer which steps the higher frequency voltage down to substantially match the voltage requirements of LED lighting device 114, a bridge rectifier which rectifies the higher frequency, lower magnitude voltage, and an output which provides the higher frequency, lower magnitude voltage to lighting device 114. Further examples of drivers which may be housed within housing 102 for the present invention are shown and described in, for example, U.S. Pat. No. 7,489,086 and International Publication No. WO 2011/143510.

The characteristics of drive circuit 136 may be tailored to match the input voltage to the requirements of the LED lighting device. For example, if an LED lamp having a series string of LEDs having a total forward operating voltage of 24V is to be used in a fixture connected to mains power, the exemplary drive circuit increasing the frequency, stepping down and rectifying the voltage provided above may be utilized and incorporated into the lamp.

While in the foregoing there has been set forth a preferred embodiment of the invention, it is to be understood that the present invention may be embodied in other specific forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying claims.

What is claimed is:

1. An LED Lamp comprising:

a lamp housing including a lamp base, the lamp base being capable of connecting to a source of electrical power;

at least one LED lighting device having at least one LED, the LED lighting device being electrically connected to the lamp base and being offset from a center line running vertically through the center of the lamp housing; and, at least one optic having at least two sub-optics, each sub-optic capable of allowing a different beam angle of light distribution to pass there through when aligned with the LED lighting device, the optic being integrated with the lamp housing and configured such that the optic may be rotated to align a selected sub-optic over the LED lighting device and allow a desired beam angle to be emitted by the LED lamp;

an LED drive circuit electrically connected to the lamp base and the at least one LED lighting device, the LED drive circuit being integrated within the lamp housing being capable of receiving electrical power from the lamp base and providing it to the at least one LED lighting device, wherein the LED drive circuit includes a bridge rectifier, the bridge rectifier capable of rectifying electrical power received from the lamp base before supplying rectified power to the at least one LED lighting device.

2. The LED lamp of claim 1 wherein at least one sub-optic may allow a different pattern of light to pass there through.

3. The LED lamp of claim 1 wherein at least one sub-optic may allow a different intensity of light to pass there through.

4. The LED lamp of claim 1 wherein one of the at least two sub-optics allows for light to pass through in a beam angle less than 60 degrees.

5. The LED lamp of claim 1 wherein one of the at least two sub-optics allows for light to pass through in a beam angle greater than 60 degrees.

6. The LED lamp of claim 1 wherein the at least one LED lighting device includes an LED circuit, the LED circuit including at least two LEDs connected in series.

7. The LED lamp of claim 1 wherein the LED drive circuit includes a transformer, the transformer capable of stepping voltage received from the lamp base up or down before supplying voltage to the at least one LED lighting device.

8. The LED lamp of claim 1 wherein the LED drive circuit includes an inverter, the inverter capable of stepping a voltage frequency received from the lamp base up or down before supplying voltage to the at least one LED lighting device.

9. The LED lamp of claim 1 further comprising:

at least two LED lighting devices, each of the at least two LED lighting devices being electrically connected to the lamp base; and, at least two groups of sub-optics, each group of sub-optics including one sub-optic for each of the at least two LED lighting devices, each sub-optic within each group being capable of emitting a substantially identical beam angle wherein the sub-optics of at least one of the at least two groups are capable of emitting a different beam angle of light than the sub-optics of any other of the at least two groups.

10. An LED Lamp comprising:

a lamp housing including a lamp base, the lamp base being capable of connecting to a source of electrical power;

at least one LED lighting device having at least one LED, the LED lighting device being electrically connected to the lamp base and being offset from a center line running vertically through the center of the lamp housing; and, at least one optic having at least two sub-optics, each sub-optic capable of allowing a different beam angle of light distribution to pass there through when aligned with the LED lighting device, the optic being integrated with the lamp housing and configured such that the optic may be rotated to align a selected sub-optic over the LED lighting device and allow a desired beam angle to be emitted by the LED lamp;

an LED drive circuit electrically connected to the lamp base and the at least one LED lighting device, the LED drive circuit being integrated within the lamp housing and being capable of receiving electrical power from the lamp base and providing it to the at least one LED lighting device, wherein the LED drive circuit includes a transformer, the transformer capable of stepping voltage received from the lamp base up or down before supplying voltage to the at least one LED lighting device.

11. The LED lamp of claim 10 wherein at least one sub-optic may allow a different pattern of light to pass there through.

12. The LED lamp of claim 10 wherein at least one sub-optic may allow a different intensity of light to pass there through.

13. The LED lamp of claim 10 wherein one of the at least two sub-optics allows for light to pass through in a beam angle less than 60 degrees.

14. The LED lamp of claim 10 wherein one of the at least two sub-optics allows for light to pass through in a beam angle greater than 60 degrees.

15. The LED lamp of claim 10 wherein the at least one LED lighting device includes an LED circuit, the LED circuit including LEDs formed as a bridge rectifier with an LED connected across the output of the rectifier.

16. The LED lamp claim 10 wherein the at least LED lighting device includes an LED circuit, the LED circuit including at least two LEDs connected in an anti-parallel configuration.

17. The LED lamp of claim 10 wherein the at least one LED lighting device includes an LED circuit, the LED circuit including at least two LEDs connected in series.

18. The LED lamp of claim 10 wherein the LED drive circuit includes an inverter, the inverter capable of stepping a voltage frequency received from the lamp base up or down before supplying voltage to the at least one LED lighting device.

19. The LED lamp of claim 10 further comprising:

at least two LED lighting devices, each of the at least two LED lighting devices being electrically connected to the lamp base; and, at least two groups of sub-optics, each group of sub-optics including one sub-optic for each of the at least two LED lighting devices, each sub-optic within each group being capable of emitting a substantially identical beam angle wherein the sub-optics of at least one of the at least two groups are capable of emitting a different beam angle of light than the sub-optics of any other of the at least two groups.

20. An LED Lamp comprising:

a lamp housing including a lamp base, the lamp base being capable of connecting to a source of electrical power;

at least one LED lighting device having at least one LED, the LED lighting device being electrically connected to the lamp base and being offset from a center line running vertically through the center of the lamp housing; and, at least one optic having at least two sub-optics, each sub-optic capable of allowing a different beam angle of light distribution to pass there through when aligned with the LED lighting device, the optic being integrated with the lamp housing and configured such that the optic may be rotated to align a selected sub-optic over the LED lighting device and allow a desired beam angle to be emitted by the LED lamp;

an LED drive circuit electrically connected to the lamp base and the at least one LED lighting device, the LED drive circuit being integrated within the lamp housing and being capable of receiving electrical power from the lamp base and providing it to the at least one LED lighting device, wherein the LED drive circuit includes an inverter, the inverter capable of stepping a voltage frequency received from the lamp base up or down before supplying voltage to the at least one LED lighting device.

21. The LED lamp of claim 20 wherein at least one sub-optic may allow a different pattern of light to pass there through.

22. The LED lamp of claim 20 wherein at least one sub-optic may allow a different intensity of light to pass there through.

23. The LED lamp of claim 20 wherein one of the at least two sub-optics allows for light to pass through in a beam angle less than 60 degrees.

24. The LED lamp of claim 20 wherein one of the at least two sub-optics allows for light to pass through in a beam angle greater than 60 degrees.

25. The LED lamp of claim 20 wherein the at least one LED lighting device includes an LED circuit, the LED circuit including LEDs formed as a bridge rectifier with an LED connected across the output of the rectifier.

26. The LED lamp claim 20 wherein the at least LED lighting device includes an LED circuit, the LED circuit including at least two LEDs connected in an anti-parallel configuration.

27. The LED lamp of claim 20 wherein the at least one LED lighting device includes an LED circuit, the LED circuit including at least two LEDs connected in series.

28. The LED lamp of claim 20 further comprising:

at least two LED lighting devices, each of the at least two LED lighting devices being electrically connected to the lamp base; and, at least two groups of sub-optics, each group of sub-optics including one sub-optic for each of the at least two LED lighting devices, each sub-optic within each group being capable of emitting a substantially identical beam angle wherein the sub-optics of at least one of the at least two groups are capable of emitting a different beam angle of light than the sub-optics of any other of the at least two groups.

29. An LED Lamp comprising:

a lamp housing including a lamp base, the lamp base being capable of connecting to a source of electrical power;

at least two LED lighting devices, each of the at least two LED lighting devices being electrically connected to the lamp base and being offset from a center line running vertically through the center of the lamp housing; and, at least one optic having at least two groups of sub-optics each group of sub-optics including one sub-optic for each of the at least two LED lighting devices, each sub-optic within each group being capable of emitting a substantially identical beam angle, wherein the sub-optics of at least one of the at least two groups are capable of emitting a different beam angle of light than the sub-optics of any other of the at least two groups, the optic being integrated with the lamp housing and configured such that the optic may be rotated to align a selected group of sub-optics over the at least two LED lighting devices and allow a desired beam angle to be emitted by the LED lamp.

30. The LED lamp of claim 29 wherein at least one sub-optic may allow a different pattern of light to pass there through.

31. The LED lamp of claim 29 wherein at least one sub-optic may allow a different intensity of light to pass there through.

32. The LED lamp of claim 29 wherein one of the at least two sub-optics allows for light to pass through in a beam angle less than 60 degrees.

33. The LED lamp of claim 29 wherein one of the at least two sub-optics allows for light to pass through in a beam angle greater than 60 degrees.

34. The LED lamp of claim 29 wherein the at least one LED lighting device includes an LED circuit, the LED circuit including LEDs formed as a bridge rectifier with an LED connected across the output of the rectifier.

35. The LED lamp claim 29 wherein the at least LED lighting device includes an LED circuit, the LED circuit including at least two LEDs connected in an anti-parallel configuration.

36. The LED lamp of claim 29 wherein the at least one LED lighting device includes an LED circuit, the LED circuit including at least two LEDs connected in series.

37. The LED lamp of claim 29 further comprising an LED drive circuit electrically connected to the lamp base and the at least one LED lighting device, the LED drive circuit being integrated within the lamp housing and being capable of receiving electrical power from the lamp base and providing it to the at least one LED lighting device.

38. The LED lamp of claim 29 further comprising an LED drive circuit electrically connected to the lamp base and the at least one LED lighting device, the LED drive circuit being integrated within the lamp housing and being capable of receiving electrical power from the lamp base and providing it to the at least one LED lighting device.

39. An LED Lamp comprising;

a lamp housing including a lamp base, the lamp base being capable of connecting to a source of electrical power;

at least one LED lighting device having at least one LED, the LED lighting device being electrically connected to the lamp base and being offset from a center line running vertically through the center of the lamp housing; and, at least one optic having at least two sub-optics, each sub-optic capable of allowing a different beam angle of light distribution to pass there through when aligned with the LED lighting device, the optic being integrated with the lamp housing and configured such that the optic may be rotated to align a selected sub-optic over the LED lighting device and allow a desired beam angle to be emitted by the LED lamp;

wherein the at least one LED lighting device includes an LED circuit, the LED circuit including LEDs formed as a bridge rectifier with an LED connected across the output of the rectifier.

40. The LED lamp of claim 39 wherein at least one sub-optic may allow a different pattern of light to pass there through.

41. The LED lamp of claim 39 wherein at least one sub-optic may allow a different intensity of light to pass there through.

42. The LED lamp of claim 39 wherein one of the at least two sub-optics allows for light to pass through in a beam angle less than 60 degrees.

43. The LED lamp of claim 39 wherein one of the at least two sub-optics allows for light to pass through in a beam angle greater than 60 degrees.

44. An LED Lamp comprising:

a lamp housing including a lamp base, the lamp base being capable of connecting to a source of electrical power;

at least one LED lighting device having at least one LED, the LED lighting device being electrically connected to the lamp base and being offset from a center line running vertically through the center of the lamp housing; and, at least one optic having at least two sub-optics, each sub-optic capable of allowing a different beam angle of light distribution to pass there through when aligned with the LED lighting device, the optic being integrated with the lamp housing and configured such that the optic may be rotated to align a selected sub-optic over the LED lighting device and allow a desired beam angle to be emitted by the LED lamp;

wherein the at least LED lighting device includes an LED circuit, the LED circuit including at least two LEDs connected in an anti-parallel configuration.

45. The LED lamp of claim 44 wherein at least one sub-optic may allow a different pattern of light to pass there through.

46. The LED lamp of claim 45 wherein at least one sub-optic may allow a different intensity of light to pass there through.

47. The LED lamp of claim 46 wherein one of the at least two sub-optics allows for light to pass through in a beam angle less than 60 degrees.

48. The LED lamp of claim 47 wherein one of the at least two sub-optics allows for light to pass through in a beam angle greater than 60 degrees.

49. An LED Lamp comprising:

a lamp housing including a lamp base, the lamp base being capable of connecting to a source of electrical power;

at least one LED lighting device having at least one LED, the LED lighting device being electrically connected to the lamp base and being offset from a center line running vertically through the center of the lamp housing; and, at least one optic having at least two sub-optics, each sub-optic capable of allowing a different beam angle of light distribution to pass there through when aligned with the LED lighting device, the optic being integrated with the lamp housing and configured such that the optic may be rotated to align a selected sub-optic over the LED lighting device and allow a desired beam angle to be emitted by the LED lamp;

wherein the at least one LED lighting device includes an LED circuit, the LED circuit including at least two LEDs connected in series.

50. The LED lamp of claim 49 wherein at least one sub-optic may allow a different pattern of light to pass there through.

51. The LED lamp of claim 49 wherein at least one sub-optic may allow a different intensity of light to pass there through.

52. The LED lamp of claim 49 wherein one of the at least two sub-optics allows for light to pass through in a beam angle less than 60 degrees.

53. The LED lamp of claim 49 wherein one of the at least two sub-optics allows for light to pass through in a beam angle greater than 60 degrees.

* * * * *